US009239200B2

(12) United States Patent
Kuparinen

(10) Patent No.: US 9,239,200 B2
(45) Date of Patent: Jan. 19, 2016

(54) SAFETY DEVICE OF A GUN AND METHOD FOR USING SAFETY DEVICE

(75) Inventor: Kari Kuparinen, Topeno (FI)

(73) Assignee: SAKO LTD, Riihimaki (FI)

( * ) Notice: Subject to any disclaimer, the term of this patent is extended or adjusted under 35 U.S.C. 154(b) by 0 days.

(21) Appl. No.: 14/126,590

(22) PCT Filed: Jun. 14, 2012

(86) PCT No.: PCT/FI2012/050609

§ 371 (c)(1),
(2), (4) Date: Mar. 21, 2014

(87) PCT Pub. No.: WO2012/172182

PCT Pub. Date: Dec. 20, 2012

(65) Prior Publication Data

US 2014/0230296 A1 Aug. 21, 2014

(30) Foreign Application Priority Data

Jun. 16, 2011 (FI) ..... 20115610

(51) Int. Cl.
*F41A 17/06* (2006.01)
*F41A 17/08* (2006.01)

(52) U.S. Cl.
CPC ..... *F41A 17/06* (2013.01); *F41A 17/063* (2013.01); *F41A 17/08* (2013.01)

(58) Field of Classification Search
CPC ..... F41A 17/00; F41A 17/06; G08B 21/00; G08B 21/02; G08B 1/08
USPC ..... 42/1.01, 70.07, 70.06, 66, 70.01, 70.11, 42/84
See application file for complete search history.

(56) References Cited

U.S. PATENT DOCUMENTS 5,307,053 A * 4/1994 Wills et al. ..... 340/573.1
6,320,975 B1 * 11/2001 Vieweg ..... 382/124

(Continued)

FOREIGN PATENT DOCUMENTS

EP 1 605 222 12/2005
GB 2 425 669 11/2006

(Continued)

OTHER PUBLICATIONS

International Search Report dated Oct. 8, 2012, corresponding to PCT/FI2012/050609.

(Continued)

*Primary Examiner* — Joshua Freeman
(74) *Attorney, Agent, or Firm* — Young & Thompson

(57) ABSTRACT

A safety device of a gun includes elements for determining the geographical location of the gun and the shooting direction, elements for receiving via a short range radio link from a gun user's mobile phone a safety area map related to the current location and location data of moving or fixed targets in this safety area. The safety device additionally has elements for determining those moments, when the gun is in the shooting position. When the gun is in the shooting position the safety device determines the risk area, within which there must be no targets preventing shooting. The safety device determines the size of the safety area based on the type of gun and the shooting direction of the gun. If it is detected that there are targets preventing shooting in the determined risk area, then the safety device generates a warning detectable with humans senses regarding this.

21 Claims, 8 Drawing Sheets

(56) References Cited

U.S. PATENT DOCUMENTS

Figure 1A:
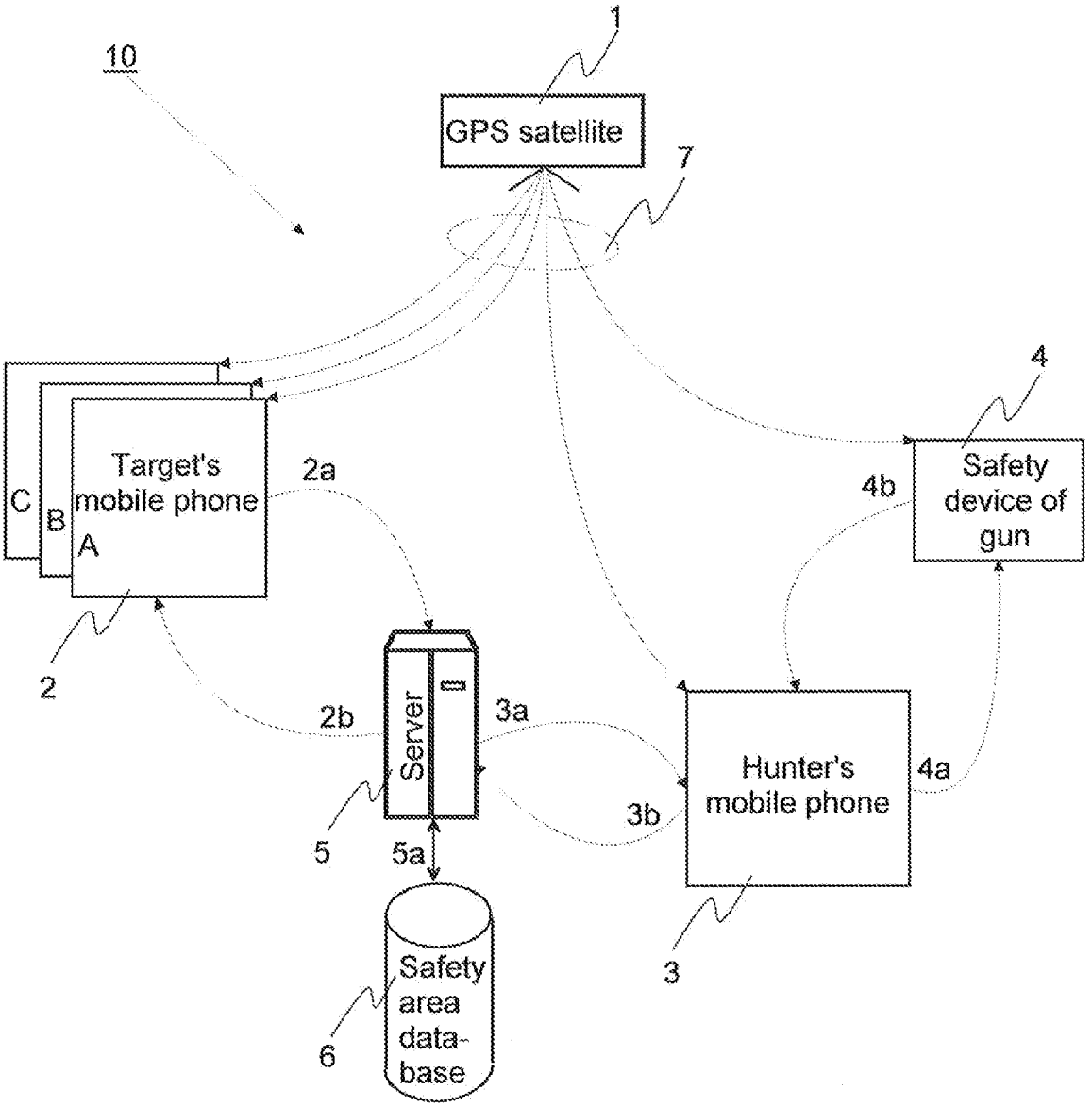

| | | | | |
|---|---|---|---|---|
| 7,196,655 | B1 * | 3/2007 | Hayles et al. | 342/45 |
| 8,125,371 | B1 * | 2/2012 | Daniel | 342/45 |
| 2004/0005532 | A1 | 1/2004 | Schmedemann | |
| 2004/0099134 | A1 * | 5/2004 | Gotfried | 89/1.11 |
| 2007/0205890 | A1 * | 9/2007 | Brown | 340/539.23 |
| 2008/0165047 | A1 | 7/2008 | Fisher et al. | |
| 2009/0158954 | A1 | 6/2009 | Wardecki et al. | |
| 2012/0073178 | A1 * | 3/2012 | Ivtsenkov et al. | 42/70.06 |

FOREIGN PATENT DOCUMENTS

| | | |
|---|---|---|
| WO | 2008/048116 | 4/2008 |
| WO | 2009/130732 | 10/2009 |
| WO | 2010/145671 | 12/2010 |

OTHER PUBLICATIONS

Finnish Search Report dated Nov. 18, 2011, corresponding to the Foreign Priority Application No. 20115610.

* cited by examiner

SAFETY DEVICE OF A GUN AND METHOD FOR USING SAFETY DEVICE

The invention relates to a safety device of a gun, a method for using the safety device and a warning system for a shooter or a hunter to be used in connection with the safety device.

PRIOR ART

In connection with hunting it has occurred that a hunter has, instead of game, shot some other person moving close to the shooter. The victim may have either been another hunter, some outsider or external property, such as a building, a car or the like, which has arrived at the hunting area or is situated there. In order to avoid such accidents hunting parties agree before starting the hunt, who will hunt where and in which direction a particular hunter is allowed to shoot. In practice it is difficult to adhere to the appointed rules. The terrain may be previously unknown to the hunter, so he may settle in a spot, which belongs to the shooting sector of some other hunter.

In a corresponding manner it is in military or other authority applications very important that persons performing a task do not by accident shoot their own or persons performing the same task or being on the same side. The need is especially highlighted in special tasks realised in a foreign environment, where a hit squad is sent to a previously unknown or somehow pre-scouted place to perform a set task.

Also the used hunting weapon has significance when assessing a risk area of a gun. The range of a shotgun is comparatively short, at the most a few hundred meters, but the shooting sector in the range area is wide. With a rifle the range can be several kilometers in an open, even terrain. The risk area achieved by a bullet is however narrow in the area close to the shooter.

In connection with hunting there may also be dogs in the hunting area, which dogs are used either for finding game or for fetching shot game. Hunting dogs are generally equipped with so-called dog radars, by means of which their location can be determined quite precisely. In the newest dog radars the device carried by the dog contains a GPS positioning device. The location data determined by the GPS positioning device is relayed via a suitable cellular network to a server, where location data of the hunting dog is maintained. From the server the location data for the dog can be transferred via a suitable data transfer network to a data processing device of one or several hunters, where the location of the dog can be presented on a map. Such a data processing device can for example be a mobile phone, where a suitable program for monitoring a dog has been stored. When the hunter knows his own location, he can with the aid of the mobile phone locate the dog used for hunting. Based on this data the hunter can make his decision about continuing the hunting.

If the dog has a GPS positioning device, the GPS location data can also be transferred via a radio link to a data processing device the hunter has.

If the dog has a common RF transmitter, the direction and rough distance can be determined with a suitable bearing device.

Positioning applications for guns are also known.

For example in WO 2008/048116 an enemy target location is localized by utilizing geographical place and orientation firearms of two or more soldiers after they have fired an enemy. The orientation equipment is couple able to the gun. The location and orientation information are combined in a auxiliary processor apparatus.

WO 2010/145671 depicts a safety apparatus of a firearm that includes an enabling/blocking device, which can be changed to a first state, which allows a shot to be fired, and to a second state, which prevents a shot from being fired. A shot is possible only when an auxiliary authorization signal form a particular control apparatus has been sent to enabling/locking device of the firearm.

In US 2008/165047 it is depicted a systems and method of tracking and/or avoiding harm to certain devices or humans. In the reference sounds of enemy fire and shooting sound arrival times are utilized to conclude the direction and position of enemy targets. When locations of own soldiers can be verified with GPS navigation in that case orientation of guns of the own soldiers during shooting can be used to define place of the enemy targets. The depicted system can be used also to make a conclusion that the fire is directed to own forces.

Publication WO 2009/130732 discloses a monitoring device to be attached to or integrated into a gun, by means of which device with a GPS positioning device the current location of a certain gun and the location of shots possibly fired with the gun and the occurrence time of the shots can be determined. This data is stored both in the monitoring device and in a separate database, from which measuring data related to the gun can be analysed afterwards. The disclosed system can however not be used to anticipate in a shooting situation what kind of danger persons in the vicinity get into, if a shot is fired with the gun.

In order to avoid unwanted shooting accidents in connection with hunting, the shooter needs to have access to the best possible view of persons moving in the vicinity, both other hunters and other persons moving at the time, when the gun is lifted into the shooting position. Unfortunately hunters and other gun users do not have means available to them, which would indicate persons moving in the vicinity sufficiently precisely and quickly. Such a system or means would make it significantly easier for a hunter or other gun user to make decisions in a shooting situation, where there is a possibility of a gun accident.

SUMMARY OF THE INVENTION

The object of the invention is to introduce a new safety method for a gun, a safety device arrangement and a safety device utilised therein, by means of which a hunter or another person performing shooting has information at the time of shooting regarding whether there is a risk factor in the shooting sector of the gun, due to which the gun should not be shot with.

The objects of the invention are attained with a safety device and method, where a safety device in the gun comprises wireless reception means for receiving direction and/or location data of targets to be minded in the risk area and means for generating a warning, if the hunter's gun in the shooting position points toward such a target to be minded.

When the gun is lifted into the shooting position, the safety device identifies the shooting position and using an electronic compass also the shooting direction and advantageously also the angle of the barrel of the gun from the horizontal plane. Using the direction, position and/or location data the safety device is arranged to indicate to the gun user those situations, where there is a target in the shooting sector of the gun in the risk area defined for the gun, due to which target the gun should not be shot with.

Depending on the manner of defining the location data, the location data may be precise, such as a GPS location, or imprecise, if the warning device only has a radio transmitter, the location of which is estimated from the direction and the audibility of the radio signal.

An advantage of the invention is that in a shooting situation it is possible to indicate to the shooter whether there is a target in the shooting sector in the safety area, due to which target the shooting should not be realised.

It is further an advantage of the invention that also fixed obstacles in the shooting line in the terrain, such as buildings, may be arranged to also indicate a warning to the shooter.

It is still an advantage of the invention that when the precise location of the shooter is known, roads in the terrain can be arranged to indicate a warning to the shooter. This is important because on the roads there are probably also such people moving around, the precise location data of which is not available.

The safety method according to the invention is characterised in that in order to indicate a target, an electronic safety device in the gun is used for determining the risk area of the gun at the time of shooting and identifying targets preventing shooting in the shooting direction of the gun in its risk area from location data regarding targets preventing shooting stored in the memory of the electronic safety device.

The electronic safety device for a gun according to the invention, which comprises a power source, a processor unit, a memory, data transfer means for establishing at least one wireless data transfer connection and an acceleration sensor, is characterised in that it comprises an electronic compass and that a computer program code stored in the memory of the safety device is together with the processor unit arranged to generate a warning signal detectable with human senses by using location data of the gun, position and direction data of the gun and location data regarding targets in the risk area of the gun stored in the memory of the electronic safety device, if it has been determined that a target preventing shooting is present in the risk area of the gun at the time of shooting with the gun.

The safety device program according to the invention is characterised in that it comprises computer code means stored in a computer-readable storage means, which code means are arranged to determine the risk area of the gun at the time of shooting and identify targets preventing shooting in the shooting direction of the gun in its risk area from location data regarding targets preventing shooting stored in the memory of the electronic safety device.

Some advantageous embodiments of the invention are presented in the dependent claims.

The basic idea of the invention is the following: The gun comprises a safety device according to the invention, which may either be a separate safety device to be attached to the gun or a safety device included in the structure of the gun. The safety device advantageously comprises an electric power source, a processor unit and a thereto connected memory unit, wherein the computer program generating the warning according to the invention is stored. The safety device further comprises advantageously at least means for implementing a short-range radio link, a GPS positioning device, an electronic compass, advantageously a triaxial acceleration sensor, an angle sensor and means for delivering a warning to the shooter regarding a possible situation preventing shooting. The warning means may comprise means for providing a warning executed with light, sound or vibration.

If the safety device has a GPS positioning device, the geographical location of the shooter can when necessary be determined precisely. Further when the gun used by the shooter is known, it can be determined how far from the shooter the safety area extends and how wide the safety sector based on the gun is in the shooting direction. This data can advantageously be transmitted via a wireless radio network to a hunter's mobile phone. From the mobile phone the data can further be transmitted via the serving cellular network to a separate safety area server.

The location and location determination time stamps are also stored in the safety area server for all those other people moving around, who have activated the safety area computer program according to the invention in their own data processing devices.

The safety area server determines with the aid of positioning data those people or fixed targets, which are in the safety area determined for the gun. The determined safety area is advantageously a circular area, in the centre point of which the shooter is. The size of the safety area depends on the used gun and advantageously also on the shapes of the terrain around the shooter. Information about targets in this safety area is transferred from the safety area server via the hunter's mobile phone to the safety device in the gun. If there are moving targets among the targets, the location data of the moving target is updated in the safety area server advantageously based on the detected movement speed of the target. The faster the movement of the monitored target is, the more frequently the location data of the monitored target is updated in the shooter's/hunter's safety device.

The direction and/or location data of targets in the safety area can be transferred from the targets to be minded to the safety device also via a direct radio link. If the target has a GPS positioning device, its positioning result with its time stamps can be transferred via radio link either to the mobile phone of a safety service customer or to the safety device of the gun.

The compass direction of the safety area and the rough distance estimate of the target to be minded can be determined also with an RF bearing device, if the target has with him an RF transmitter.

When the safety device in the gun identifies that the gun is lifted into shooting position, the shooting direction of the gun is determined advantageously with the aid of the electronic compass of the safety device. Thereafter the program for generating a warning in the safety device determines whether there are targets in the risk area in the direction determined by the direction of the barrel of the gun, regarding which targets the shooter must be warned. If there are, the shooter is indicated either with a light, a sound or vibration, that a shot in the present direction could cause harm.

According to an advantageous embodiment of the invention the invention is used in connection with hunting.

According to another advantageous embodiment of the invention the invention is used in military or other authority operations.

DESCRIPTION OF ADVANTAGEOUS EMBODIMENTS OF THE INVENTION

Figure 2:
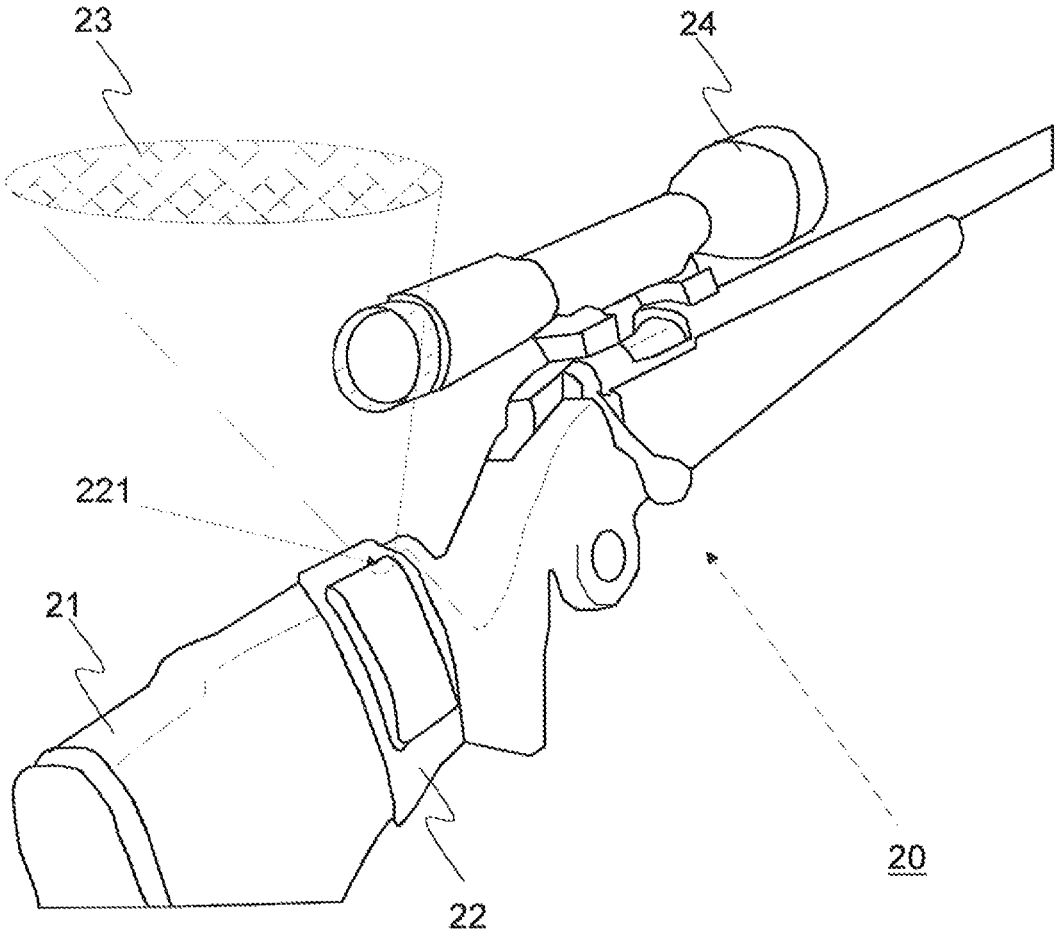
Figure 3:
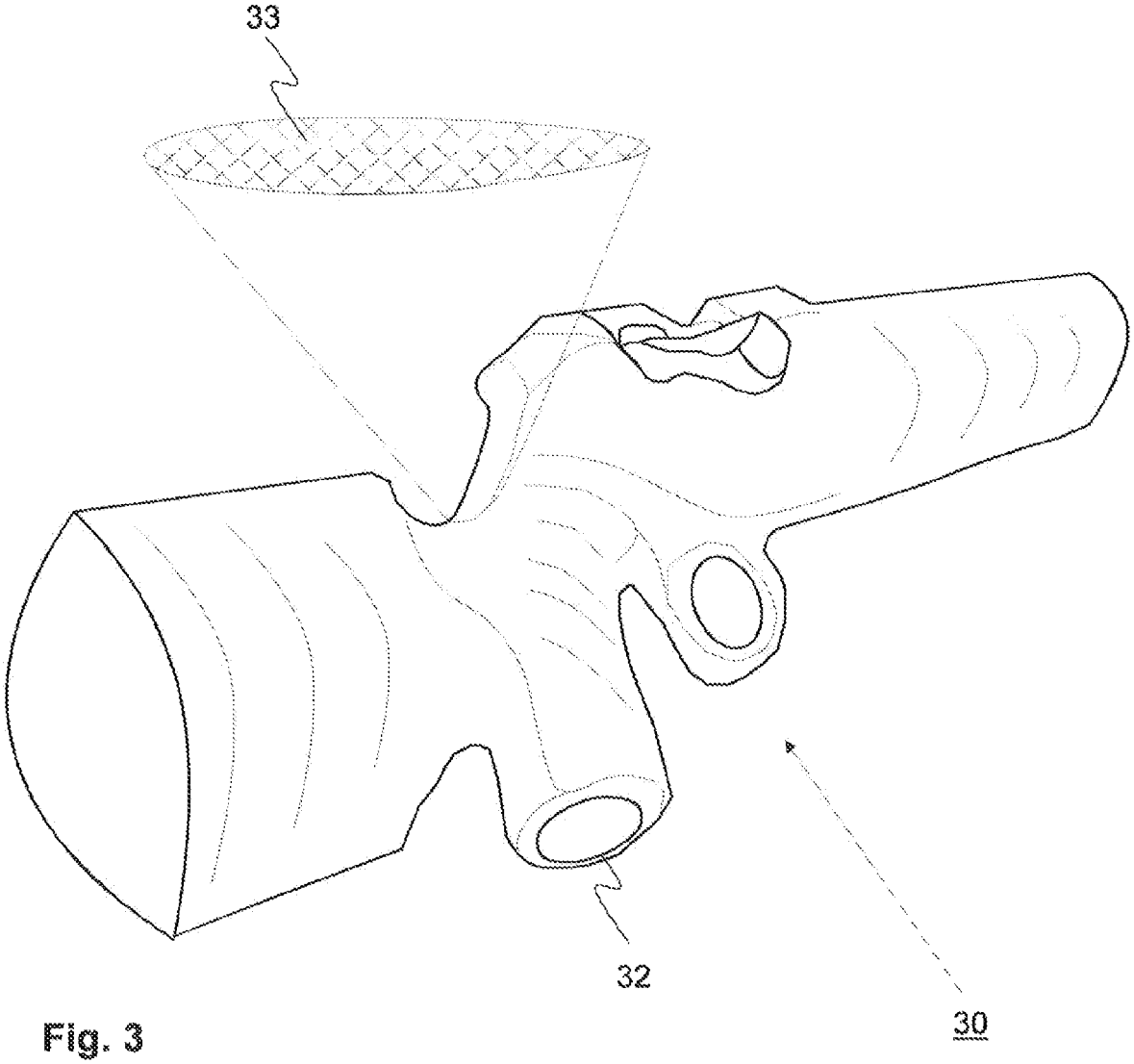
Figure 4:
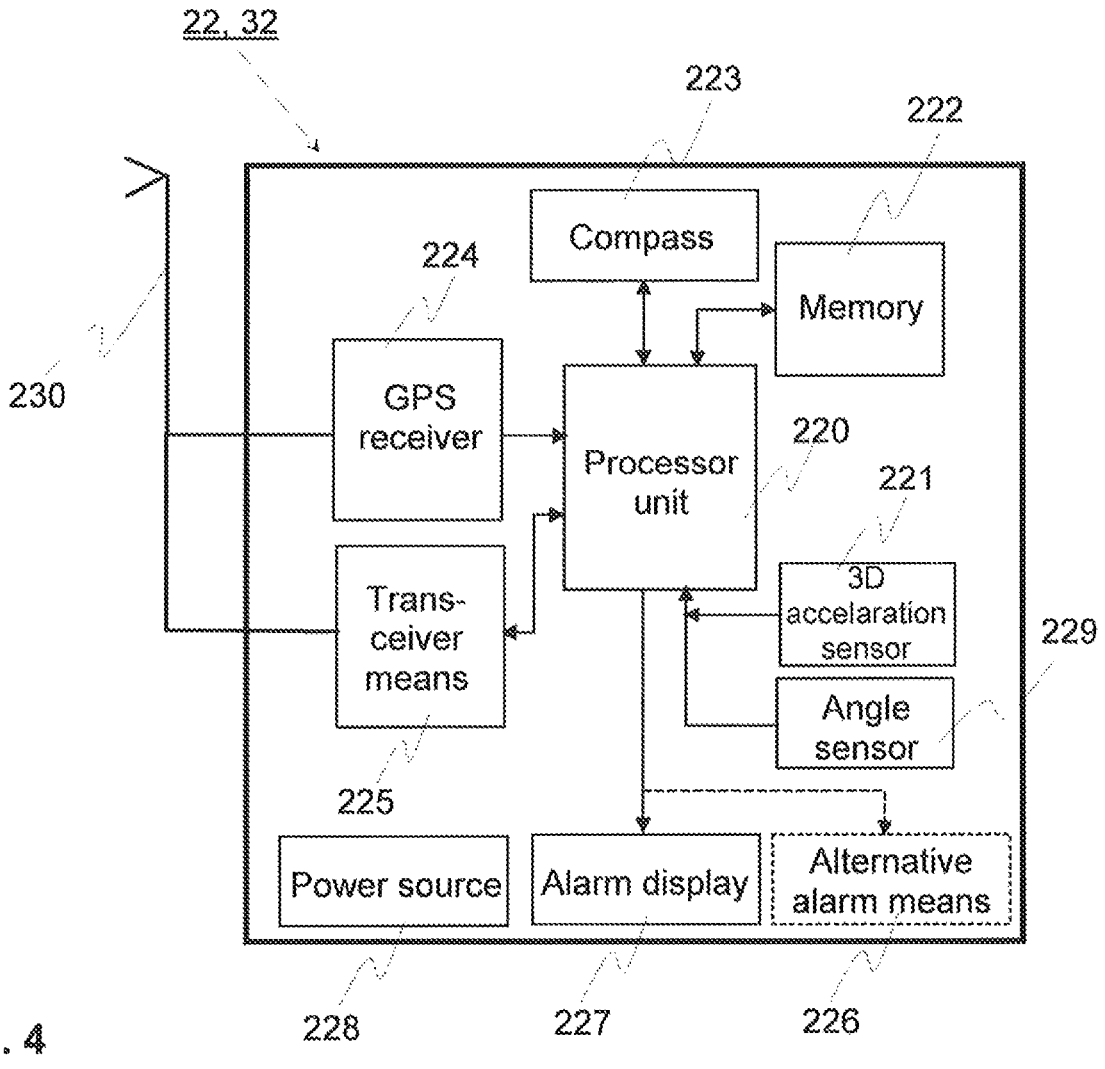
Figure 5A:
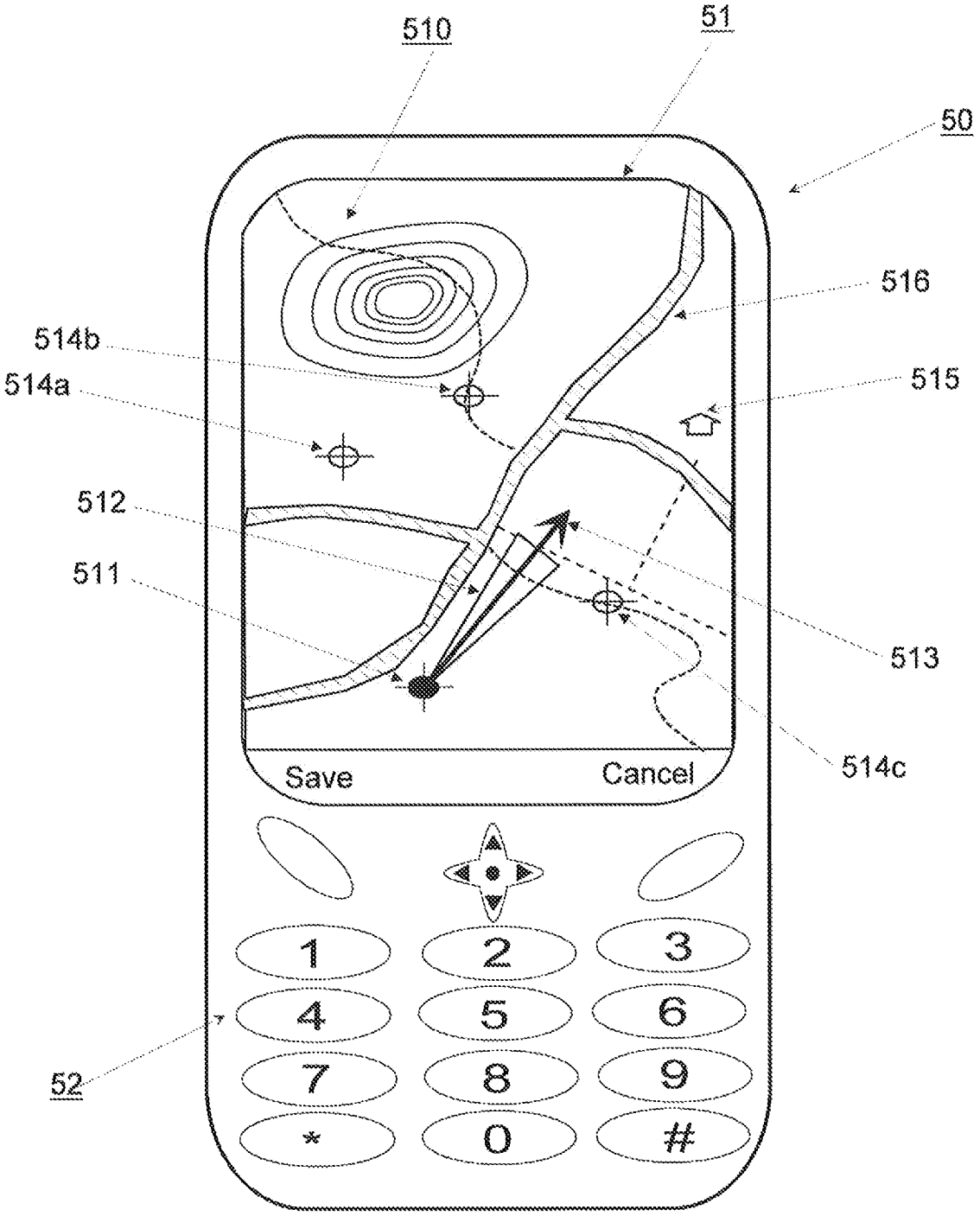
Figure 5B:
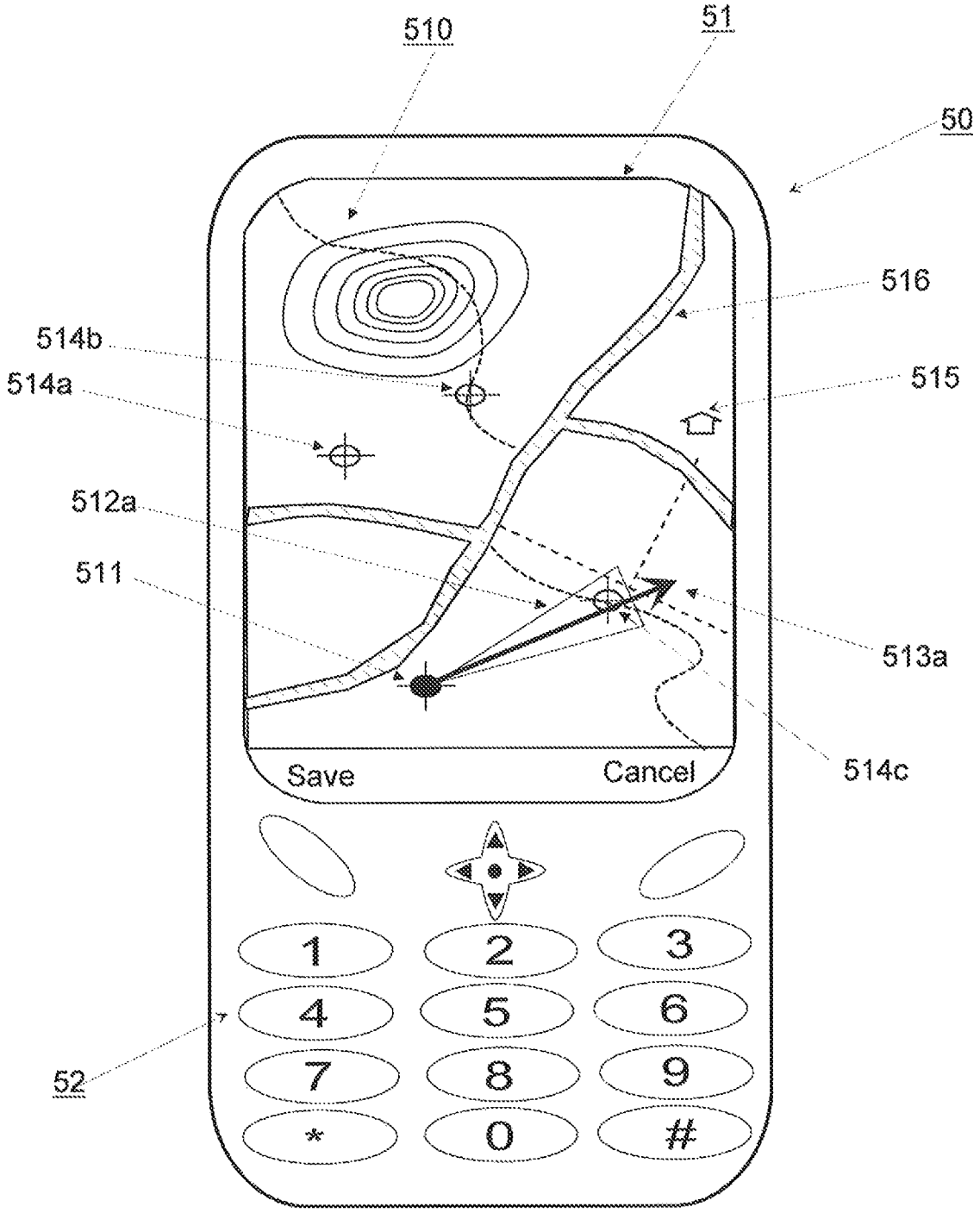
Figure 6:
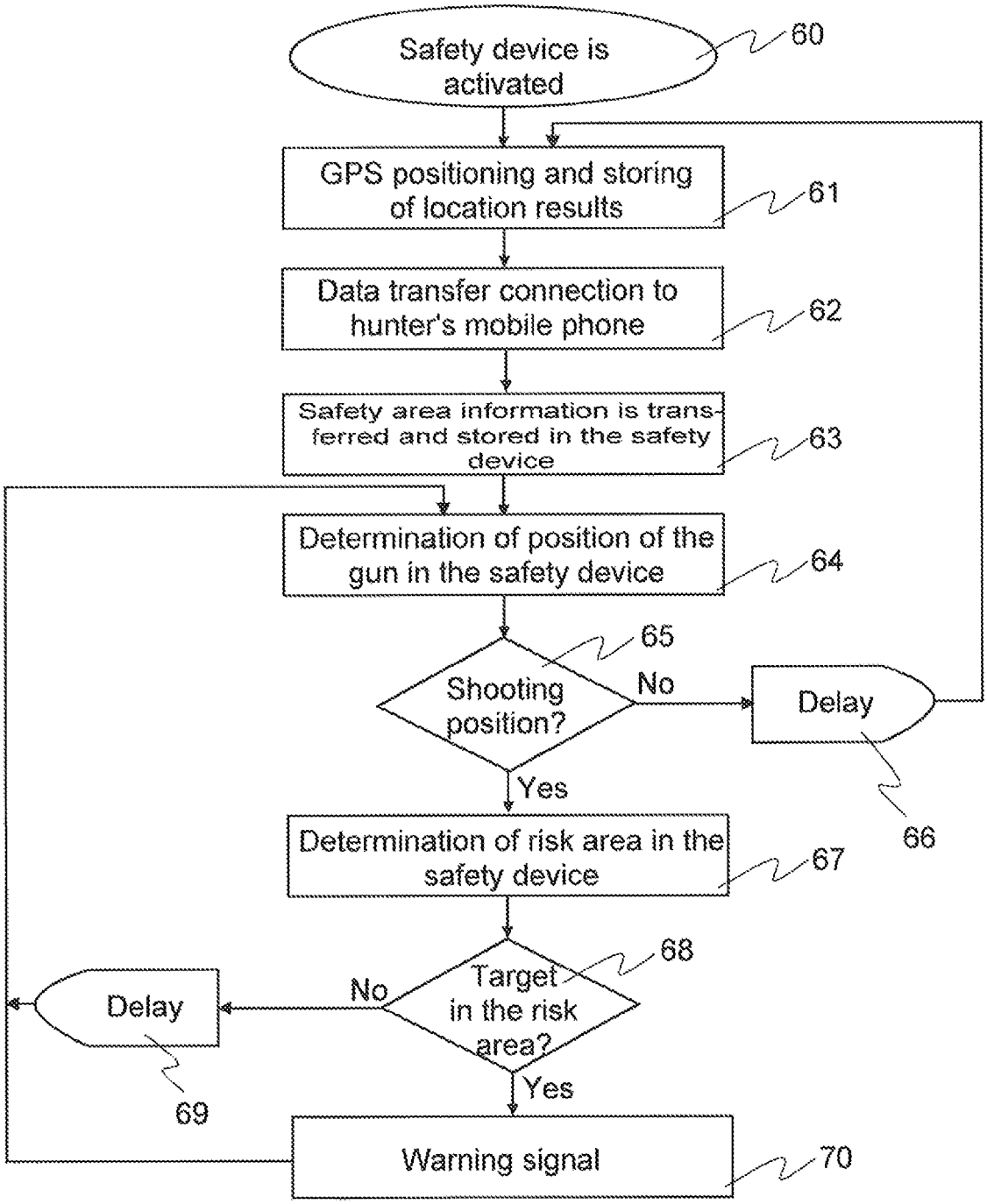

In the following, the invention will be described in detail. In the description, reference is made to the enclosed drawings, in which FIG. 1*a* shows as an example functional parts of a system for warning a shooter, FIG. 1*b* shows as an example a second system for warning a shooter and its functional parts, FIG. 1*c* shows as an example a third system for warning a shooter and its functional parts, FIG. 2 shows as an example a safety device according to the invention which can be attached to a butt of a gun, FIG. 3 shows as an example a safety device according to the invention which is integrated as a fixed part in a gun, FIG. 4 shows as an example functional main parts of a safety device according to the invention, FIG. 5*a* shows as an example a display of the direction of a gun generated on a display of a hunter's mobile phone with the aid of the safety device according to the invention, FIG. 5*b* shows as an example a warning generated on the display of a hunter's mobile phone with the aid of the safety device according to the invention when a target to be warned about is in the risk area of the gun and FIG. 6 shows as an exemplary flowchart one manner of generating a warning in the safety device according to the invention.

The embodiments in the following description are given as examples only, and someone skilled in the art may carry out the basic idea of the invention also in some other way than what is described in the description. Though the description may refer to a certain embodiment or embodiments in several places, this does not mean that the reference would be directed towards only one described embodiment or that the described characteristic would be usable only in one described embodiment. The individual characteristics of two or more embodiments may be combined and new embodiments of the invention may thus be provided.

Figure 1B:
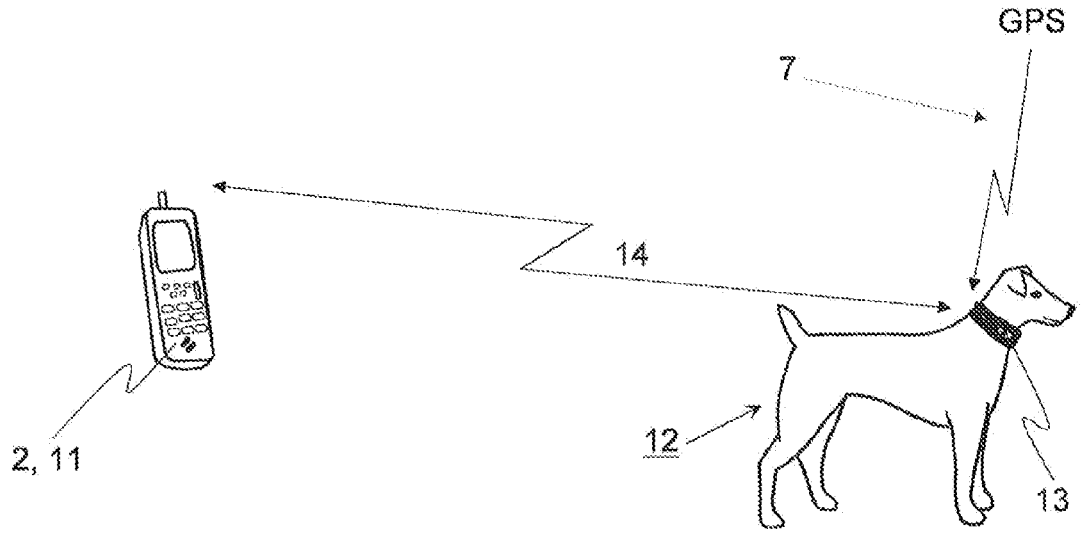
Figure 1C:
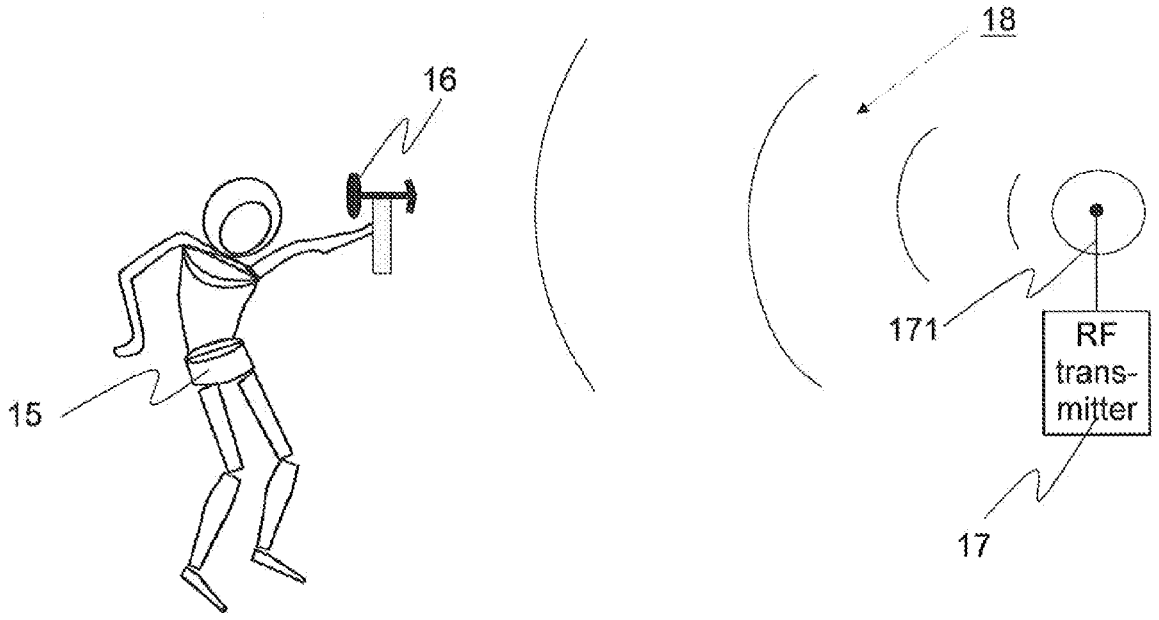

FIGS. 1*a*, 1*b* and 1*c* show as an example three data acquisition procedures, by means of which a direction and location file can be generated in the safety device of a gun according to the invention, which file the safety device according to the invention can utilise for generating a warning.

FIG. 1*a* shows a safety area arrangement 10, which the safety device 4 of a gun according to the invention advantageously utilises. Both the hunter's mobile phone 3, the safety device 4 of the gun and the mobile phones 2 of the people 2A, 2B and 2C moving in the safety area contain a suitable GPS receiver. The GPS system comprises at least twenty-four satellites 1 orbiting earth, which satellites send their time and location data to the GPS receivers (only one exemplary satellite is presented in FIG. 1). In order for the GPS receiver to perform the positioning accurately, it must receive time and location data from at least three different GPS satellites. From the time and location data is receives, the GPS receiver calculates with mathematical equations its geographical location on the earth's surface. In order to improve the positioning accuracy and/or speed up the positioning, several mobile phone operators relay correction data in their network, which the GPS positioning device can utilise (so-called A-GPS). This system allows for an accuracy level of a few meters in the positioning.

In the example of FIG. 1*a* references 2A, 2B and 2C illustrate targets, which have a mobile phone 2 and a GPS positioning device in each of these. For someone skilled in the art it is obvious that instead of a mobile phone, the reference 2 can also be some other device capable of establishing a connection to a circuit or packet connected cellular network. Examples of such devices are a PDA (Personal Digital Assistant), a portable computer, a so-called tablet computer or an onboard computer.

Each of the mentioned moving targets 2A, 2B and 2C, which may be humans or vehicles, has activated in their mobile phone 2 a monitoring application according to the invention. The hunter has in turn activated a safety application according to the invention in his mobile phone 3. The hunter has additionally activated a safety device 4 according to the invention, connected to the gun or integrated therein. Both the monitoring and the safety application transmit the GPS positioning result made in the mobile phones 2 or 3 with its time stamp to the safety area server 5 via a wireless data transfer connection 2*a* or 3*b*. The wireless data transfer connection is advantageously some packet connected data transfer connection established in a data transfer network serving mobile phones 2 and 3.

The safety area server 5 comprises a processor or processor means, which comprise an arithmetic logic unit, a number of different registers and control circuits. A data storing arrangement, such as a memory unit or memory means, has advantageously been connected to the processor means, in which data storing arrangement the location and time data of the safety arrangement users can be stored. The memory means typically contain memory units, which allow both reading and writing functions (Random Access Memory, RAM), and memory units containing non-volatile memory, from which data can only be read (Read Only Memory, ROM).

The safety area server 5 also comprises an interface element, which comprises an input or input means for receiving data from devices, references 2*a* and 3*b*, connected to a data communications network, or from a separate database device 6, reference 5*a*. User, location and time data received with the input means is transferred to be processed by processor means of the safety area server 5. The interface element of the safety area server 5 also comprises an output or output means, with which data is transferred from the processing means of the server 5 via a user-oriented data transfer network to the mobile phones 2 and 3, references 2*b* and 3*a*, of users connected to the safety arrangement. This received data can advantageously be displayed on the display of said mobile phones.

The electronic safety device 4 of a gun according to the invention is equipped with means, by means of which it is capable of performing GPS positioning also on its own, when necessary. The electronic safety device 4 additionally comprises means, by means of which it can establish a short-range data transfer connection to a hunter's mobile phone 3. Examples of possible short-range radio networks are data transfer connections based on Bluetooth and ZigBee technologies.

Via the connection 4*a* the safety device 4 according to the invention receives information related to the safety program according to the invention stored in the memory of the hunter's mobile phone 3. This information advantageously comprises a map of the nearby area with height information and a maximum safety area determined based on the hunter's gun in the safety area server 5 and location coordinates for targets moving therein with time stamps.

In an advantageous embodiment of the invention the electronic safety device 4 may also comprise means for connecting to a cellular telephone network.

FIG. 1*b* shows a second positioning solution for a moving target, where the target to be monitored through the safety service is a dog 12, a positioning device 13 carried by which utilises a GPS positioning dispatch 7 according to FIG. 1*a*. The positioning device 13 of the target 11 being monitored sends the positioning result with the aid of a radio transmitter included in the positioning device 13 as an RF dispatch 14 to the data processing device 2, 11 of a safety service customer, which data processing device may advantageously be a mobile phone. A data transfer connection from the positioning device 13 to the mobile phone 2, 11 can be established for example as a radiophone connection using a so-called FRS service (Family Radio Service). In the FRS service, data is transmitted using an FM modulated carrier wave on UHF frequency (Ultra High Frequency). The positioning data of the target to be minded is advantageously stored in a memory unit of the mobile phone 2, 11. From the memory of the mobile phone 2, 11 the positioning data with its time stamps can advantageously be transmitted with a second short-range radio link (reference 4*a* in FIG. 1*a*) to the safety device (reference 4 in FIG. 1*a*) according to the invention in the gun.

FIG. 1*c* shows a third positioning procedure for a target which is of interest to a safety service customer 15. It may for example be question of a situation, where either one, either the safety service customer 15 or the target being monitored, is unreachable to all available radio networks. Alternatively for one reason or another, the GPS positioning device 13 of the target cannot determine the coordinates of the target. Thus the radio connection 14 shown in FIG. 1*b* cannot be utilised for transmitting coordinate data of the target being monitored to the device 2, 11 of the safety service customer.

In this case the safety service customer 15 can utilise a bearing device 16. The bearing device 16 advantageously comprises a direction antenna, a receiver with an indicator, an electronic compass, a processor and data transfer means for transferring the bearing and compass data to the electronic device 2, 4, 11 used by the safety service customer 15. The data transfer can advantageously be done via a wireless data transfer connection. The wireless applications can advantageously use an infrared, a Bluetooth or a ZigBee connection.

In the example of FIG. 1*c* a separate bearing device 16 is used, the bearing data of which is advantageously transferred via a safety service customer's 15 mobile phone 2, 3 to a safety device 4 belonging to a gun according to the invention. In an advantageous embodiment of the invention the safety service customer 15 sends a radio signal with the bearing device 16, which radio signal starts up an antenna 171 of a separate bearing transmitter in the device 17 of the target 12 being monitored. Thus the device 17 of the target 12 being followed sends radio waves 18, the incoming direction of which the safety service customer 15 searches with the bearing device 16. Depending on the beam width of the used direction antenna, the safety service customer 15 can by monitoring the level of the received signal get information about the sector, where the bearing device 17 of the target 12 being monitored is. A rough distance to the device 17 can be estimated, if the transmission power of the transmitter 17, the coverage of the terrain and possible obstacles in the terrain are known. The direction and distance data of the target can advantageously be transferred to a safety device 4 of a gun according to the invention.

In a second embodiment the bearing device 16 does not transmit a signal, with which the bearing transmitter of the device 17 is started up, or the target does not at all have a separate bearing transmitter. In this embodiment the safety service customer 15 knows that the bearing device 17 tries to establish or is able to establish a data transfer connection to some radio network known to the monitoring person or it may function as just a bearing transmitter transmitting a carrier wave. The bearing device 16 can receive this radio traffic carrier wave and utilise it for finding the direction of the target 12 to be positioned.

The RF bearing device 16 shown in FIG. 1*c* or its direction antenna may also be a fixed part of the gun. In this embodiment the shooting direction and distance data can be relayed directly to the safety device 4 according to the invention.

When a hunter, one customer of the described safety service, takes a shooting position, the means included in the safety device 4 shown in FIG. 1*a* either themselves determine or receive the shooting direction of the gun from the hunter's mobile phone 3. Based on this data the safety device 4 according to the invention determines a risk area, the targets in which may be in the shooting sector. The risk area can be determined based on the used gun and/or the shooting position. In the shooting direction of the gun the risk area advantageously corresponds to the range of the gun. If there are targets in the determined risk area, due to which targets shooting would not be desirable in order to avoid an accident, then the safety device 4 according to the invention generates a warning identifiable with human senses for the hunter.

In an advantageous embodiment of the invention the safety device 4 according to the invention transmits a message 4*b* describing a danger situation also to the hunter's mobile phone 3. The hunter can thus evaluate the necessity or uselessness of the warning message on the map of the display of the mobile phone 3 before performing the shooting.

In the safety area arrangement 10 according to the invention targets can advantageously also be taken into account, which targets are fixed or remain in place at least examined over a short time interval. Such targets are for example courtyards of residential buildings or a publicly used road or vehicles on the road. Especially the range of rifles can depending on the shooting position be so long that it is sensible to inform the hunter also of such possible risk areas.

FIG. 2 shows an example of a separate safety device 22 according to the invention, which is attached to the butt 21 of a rifle 20. When the rifle 20 is lifted into the shooting position, the safety device 22 according to the invention determines the safety area in the shooting direction of the gun. The hunter, who has taken the shooting position, receives information about a target to be avoided in the risk area advantageously with a signal which can be detected with human senses. In the example of FIG. 2 a light source 221 in the safety device 22 according to the invention generates an advantageously red light signal 23, which at least partly hits the ocular of the sight of the gun. The hunter observes the warning signal and can take necessary safety actions.

The safety device 4 according to the invention can communicate its warning also with sound or with vibration generated in the butt of the gun.

In an advantageous embodiment of the invention means are comprised in the sight 24, which means project a warning in the sight, so that the shooter sees the warning in his sight. The warning message can advantageously be transferred to the sight 24 either via a wired or wireless data transfer connection.

In a second advantageous embodiment of the invention at least the electronic components of the safety device according to the invention are integrated as a part of the sight 24. In this embodiment the power source needed by the electronics can be connected to the safety device with a cable from a battery, which may either be connected to the frame of the rifle 20 or the hunter carries it with him for example in a pocket.

In the example of FIG. 3 the safety device 32 according to the invention is integrated as a part of the mechanical structure of the gun 30. Also in the example of FIG. 3 the safety device 32 generates a light signal 33 in order to warn the hunter about a target in the risk area. In this embodiment the integration into the structure of the gun can be done so that the balance of the gun can be improved. FIG. 4 shows the functional main parts of the electronic safety device 22 or 32 according to the invention. Hereafter the safety device according to the invention is referenced with reference number 22. The safety device 22 according to the invention advantageously comprises a power source 228, a processing unit 220, a memory 222, an acceleration sensor 221, which advantageously is a 3D acceleration sensor, an angle sensor 229, an electronic compass 223, a GPS receiver 224, a transceiver 225 utilising at least one data transfer method, an antenna arrangement 230, which may comprise several antennas functioning in different frequency areas, an alarm display 227 and alternative alarm means, such as for example a buzzer 226 and/or a vibrating alarm.

When the safety device 22 contains a GPS positioning device 224, then positioning data calculated with the GPS positioning device 224 is transferred to the processing unit 220 of the safety device 22 and stored from there in the memory 222 of the safety device 22. The time between two successive positioning measurings can advantageously be determined based on if the 3D acceleration sensor 221 observes that the hunter is moving in the terrain. If no movement is observed, no new positioning measuring is needed.

The processing unit 220 of the safety device 22 advantageously comprises a suitable processor or a programmable logic and a thereto connected memory 222. The memory 222 can utilise either non-volatile and/or volatile memory technology. The electronic map utilised in the safety device 22 can be transferred to the safety device 22 for example from a special safety area server 5 or from some commercial map service.

A computer program to be utilised in the safety device according to the invention is advantageously stored in the memory 222 of the safety device 22. The processor unit 220, memory 222 and computer program stored in the memory 222 are arranged to determine in real-time the position of the gun, the direction of the barrel when the gun is in the shooting position and advantageously also the location of the gun on the map. The computer program according to the invention is also arranged to determine advantageously from the location of the gun, the shooting direction and the angle of the barrel of the gun in relation to the terrain a risk area, within which there should be no targets being monitored. Additionally the computer program is arranged to indicate all targets being monitored in the risk area when the gun is in the shooting position.

In an advantageous embodiment of the invention, location and time data from a predetermined length of time is advantageously stored in the memory 222 after the gun is lifted into the shooting position. The shooting time indicated with the acceleration sensor 221 is also stored in the memory. This data can be transferred from the safety device 22 either to the hunter's mobile phone 3 or via it to some external data processing device for situation analysis to be performed afterwards.

The processor unit 220 utilises in the risk area analysis real-time measuring data from the electronic compass 223, the acceleration sensor 221 and advantageously also from the angle sensor 229. From the measuring data of the acceleration sensor 221 the computer program according to the invention determines when the gun is lifted into the shooting position. A possible shot is also registered with the acceleration sensor.

The angle of the gun to the ground is determined based on data obtained from the angle sensor 229. This angle determines how long the safety area to be determined is in the shooting direction. If the shooter is for example in a shooting tower, the shooting direction can be downwards and the risk area is thus quite short. If, on the other hand, a rifle is used for shooting for example a bird in a tree, then the range of the bullet can be very long, whereby the risk area reaches far.

The electronic safety device 22 for a gun according to the invention also comprises a transceiver 225, which comprises means for operating on at least one frequency band. Some examples of possible short-range radio technologies, which can be used to implement a radio link between the safety device 22 and the shooter's mobile phone 3, are Bluetooth and ZigBee. Via the radio connection safety device data can be transferred in both directions: from the safety device 4 to the hunter's mobile phone 3 or from the hunter's mobile phone to the safety device.

The transceiver 225 may also comprise means for establishing a two-way RF radio link to the positioning device 13 on the target 12 being monitored. Via the radio link the positioning data with time stamps of the target determined by the positioning device can be transferred to the memory 222 of the safety device 22 according to the invention.

In an advantageous embodiment of the invention the transceiver 225 advantageously also comprises means for finding the direction of the RF radio dispatch 18. The compass direction of the RF dispatch and the rough distance estimate determined based on the strength of the signal of the RF dispatch are stored in the memory 222 of the safety device 22 according to the invention.

In an advantageous embodiment of the invention the transceiver 225 advantageously also comprises means for connecting to some cellular network.

The position data and its time stamps of the targets being monitored in the safety area can advantageously be transferred from the hunter's mobile phone 3 to the safety device 4 according to the invention. Advantageously information regarding the height relationships or coverage of the terrain and location data of possible fixed targets/obstacles in the safety area are also transferred to the safety device 4.

From the safety device 22 information related to the shooting situation can advantageously be transferred to the hunter's mobile phone 3 for example in a situation, where the safety device 22 has indicated an obstacle to be taken into account in the risk area of the gun.

When the safety device 22 indicates a target in the risk area, it is indicated to the gun user with an alarm message detectable with human senses. In the example of FIG. 4 the alarm is indicated on an alarm display 227. In the example of FIG. 4 the alarm display 227 is a part of the safety device 22, but it can also be a separate display device, which can be attached to a gun, which display device has a data transfer connection to the safety device 22.

The safety device may also comprise other alternative alarm means 226 or alarm means parallel to the alarm display 227. Such alarm means can for example be a buzzer giving an alarm sound or a vibration alarm.

FIG. 5*a* shows an example of a case, where the risk area determined by the safety device 22 of the gun has been transferred via a wireless data transfer connection to the display of the hunter's mobile phone 50. Of the functional parts of the mobile phone of FIG. 5*a*, the display 51 and the keyboard 52 are seen. For someone skilled in the art it is obvious that a fixed keyboard 52 can also be implemented by utilising a touch screen.

In the example of FIG. 5*a* a safety area map 510 is shown on the display 51, which map has advantageously been retrieved from a safety area server 5 according to the invention, shown in FIG. 1. The map can also be retrieved from some commercial map service. The safety area map to be retrieved is determined based on the hunter's GPS positioning result. The safety area map 510 advantageously shows the close surroundings of the hunter over the safety area distance determined by the gun used by the hunter.

The location of the shooter is shown in the safety area map 510 with the figure shown with reference 511. Other persons moving in the safety area determined by the assumed range of the hunter's gun are shown with the signs according to references 514*a*, 514*b* and 514*c*. Reference 515 shows a building in the safety area and reference 516 shows public roads in the safety area.

When the shooter sets his gun in a shooting position, the safety device 22 according to the invention determines the geographical direction of the gun with the aid of the electronic compass 223. The determined direction can be presented on the safety area map 510 with an arrow 513. In sector 512 the risk area of the gun at the time of shooting can advantageously be presented, in which area there should be no targets preventing shooting. The distance of the risk area 512 from the shooter 511 depends on the gun and the angle of the barrel of the gun in relation to the ground surface. In an advantageous embodiment of the invention the height relationships and coverage of the terrain is also taken into account when determining the distance of the risk area.

From the display according to FIG. 5*a* describing an alarm situation presented on the map the shooter can make conclusions about whether he can perform his shot safely in the direction, in which the gun has pointed during aiming. After having made his conclusion the hunter decides whether he shoots or not.

In the example of FIG. 5*b* the hunter has turned the shooting direction of his gun slightly to the right, whereby the target 514*c* comes into the risk area 512*a* determined for the gun. Thus an alarm 512*a* regarding the target 514*c* is generated in the safety device 22.

FIG. 6 shows as an exemplary flowchart the main steps of a safety method utilised in the safety device, references 4, 22 or 32, for a gun according to the invention. The flowchart of FIG. 6 mainly shows the main steps of the safety method utilised in the safety arrangements according to FIGS. 1*a* and 1*b*. Hereafter the safety device according to the invention is in connection with the description of the flowchart mainly referenced with reference number 22.

In connection with the example of FIG. 1*a* the safety device 22 of the gun is in step 60 activated by setting the power switch of the safety device in the "ON" position. Thereafter the GPS receiver 224 of the safety device starts receiving GPS signals from GPS satellites in step 61. Additionally the GPS receiver of the safety device 22 can advantageously utilise GPS positioning correction data offered by the serving mobile phone operator in their network in order to speed up the positioning and improve the positioning accuracy.

When the GPS receiver 224 of the safety device 22 has determined the geographical location of the safety device 22, the processor unit 220 of the safety device 22 receives the location data from the GPS receiver 224 of the safety device 22 and stores it in the memory 222 of the safety device 22.

Also in connection with the example of FIG. 1*b* the safety device 22 of the gun is in step 60 activated in the above-described manner. When the safety device's own location has been determined, then in the situation of FIG. 1*c* the safety device 22 transmits in step 61 a positioning request to the positioning device 13 of the target 12 being monitored via a radio link 14. The positioning command can advantageously be relayed via the hunter's mobile phone 3.

When the positioning device 13 of the target has performed its positioning, it sends its own positioning data with time stamps to the hunter's mobile phone 3 via a radio link 14. The positioning data of the target with time stamps is stored in the memory of the hunter's mobile phone 3.

In step 62 the processor unit 220 of the safety device controls the short range transceiver 225 to establish a wireless two-way data transfer connection 4*a*/4*b* to the hunter's mobile phone 3.

In step 63 the safety area information stored in the memory of the hunter's mobile phone 3 is transferred via the established short range radio link to the memory 222 of the safety device 22. The safety area information is transferred to the hunter's mobile phone 3 from the safety area server 5 in the examples of FIGS. 1*a*, 1*b* and 1*c* advantageously after the hunter has activated in his mobile phone 3 a safety area computer program according to the invention. The activation of this safety area computer program is advantageously done when the hunter has arrived at the hunting area. Starting up the safety area program activates a GPS positioning device in the hunter's mobile phone to make positioning measurements and store the positioning results in the safety area server 5. By proceeding thus, other hunters already in the area receive information about the location data determined by the hunter's GPS positioning device from the safety server 5, and thereafter they can utilise it in their own safety devices.

For someone skilled in the art it is obvious that the steps 61, 62 and 63 presented in the example of FIG. 6 can also be implemented in some other order than what is shown in the example of FIG. 6.

When the positioning measurement and the safety area information are stored in the memory 222 of the safety device 22, the safety device goes into a monitoring mode, which is described in step 64. In the monitoring mode the determination of the position of the gun is performed. Data obtained from the acceleration sensor 221 and/or the angle sensor 229 are advantageously utilised for determining the position of the gun.

In step 65 a decision is made regarding if the measurement result obtained in step 64 is an indication that the gun is in the shooting position or not. If the decision in step 65 finds that the gun is not in the shooting position, the process returns via a delay 66 back to step 61, where a new GPS positioning measuring is performed. The delay 66 can advantageously be pre-set by the hunter. The duration of the delay can for example depend on the manner of hunting or the hunting weapon. By utilising the delay 66 the battery 228 of the safety device 22 is preserved and the operational time of the safety device can be prolonged.

If it is in step 65 found that the gun has been lifted into the shooting position, the process moves to step 67.

A determination 512 of the risk area is performed in step 67. In the determination of the risk area the computer program utilised by the safety device 22 takes into account the direction data of the gun obtained from the electronic compass 223. In an advantageous embodiment of the invention the shooting angle of the gun in relation to the ground surface is also taken into account when determining the risk area. This data is obtained from the angle sensor 229. In an advantageous embodiment of the invention the shape of the terrain and fixed targets to be minded, such as dwellings or roads, seen on the map are also taken into account when determining the risk area. From this data the computer program utilised in the safety device according to the invention determines the final direction, width and distance of the risk area.

In step 68 the computer program utilised by the safety device 22 determines if there is a target or targets in the determined safety area, due to which a shooting should not be performed. If it is found that there is such a target to be minded in the determined risk area, then in step 70 an alarm signal regarding this is generated. The alarm signal is advantageously detectable with human senses. Examples of possible alarm signals are a light signal, a sound signal or a vibration signal.

When the alarm signal has been generated, the process returns to step 64 for a new determination of the position of the gun. If it is thus in step 65 found that the gun is no longer in the shooting position, the process returns via steps 65 and 66 to step 61. If the gun is still in the shooting position, then the process proceeds in the above-described manner again to step 67.

If it is in step 68 found that there are no targets preventing shooting in the risk area of the gun, then the process returns via a delay 69 to step 64, where a new determination of the position of the gun is done. The delay 69 can advantageously be pre-set by the hunter. The duration of the delay can for example depend on the manner of hunting or the hunting weapon. By utilising the delay the battery 228 of the safety device 22 is preserved and the operational time of the safety device can be prolonged.

When utilising the safety arrangement according to FIG. 1*c*, the flow chart of FIG. 6 can be deviated from in two ways. Because in the case of FIG. 1*c* the direction and estimated distance of the target 17 is determined with a bearing device 16, then a determination of the geographical location of the hunter 15 is not essential. In such an embodiment the activation of the safety device 22 in step 60 leads directly to step 64, where the position of the gun is determined.

Alternatively in the safety arrangement according to FIG. 1*c* the location of the hunter can be determined after the activation of the safety device 22 done in step 60 in the same way as was done in the safety arrangements of FIGS. 1*a* and 1*b*. Thereafter the process advantageously proceeds in the above-described manner up until step 68.

In the embodiment according to the safety arrangement of FIG. 1*c* the computer program utilised by the safety device 22 determines in step 68 whether an RF dispatch has been received in step 67 with the bearing device 16 from the determined safety area, due to which RF dispatch a shooting should not be performed. If such an RF dispatch about a target to be minded has been indicated in the safety area, then as in the safety arrangements of FIGS. 1*a* and 1*b*, an alarm signal is in step 70 generated from the RF dispatch.

If no RF dispatch received from the risk area is found in step 68, then the warning process according to the invention returns via a delay 69 to step 64, where the position of the gun is again determined.

All the above-described process steps can be implemented with computer program commands, which are implemented in a suitable special-purpose or general-purpose processor. The computer program commands can be stored in a computer-readable media, such as a data disk or a memory, from where the processor can retrieve said computer program commands and implement them. The references to computer-readable media can for example also contain special components, such as programmable USB Flash memories, logic arrays (FPLA), application-specific integrated circuits (ASIC) and signal processors (DSP).

Some advantageous embodiments in connection with hunting of the safety method and device according to the invention have been described above. The invention is not limited to the solutions described above, but the inventive idea can be applied in numerous ways within the scope of the claims. The invention can especially be applied, in addition to the above-presented hunting application, also to military use or other authority operations, such as among the police or the like, and in training operation related to them.

The invention claimed is:

1. A safety method for avoiding a shooting accident, in which method a target in a risk area is indicated to a shooter by an electronic safety device of a gun, comprising the steps of:

when i) the gun has been set in a shooting position and ii) before shooting the gun, the electronic safety device determines the risk area of the gun; and using location data regarding the target stored in a memory of the electronic safety device, the electronic safety device identifies the target and prevents a shooting in a shooting direction of the gun, wherein i) said location data of the targets is transferred from mobile phones of the target, as the target moves, via a cellular telecommunications network to a mobile phone of the shooter, and ii) said location data is transferred from the mobile phone of the shooter to the memory of the safety device, the stored location data in the memory of the safety device to be utilized for indicating to the shooter that the targets are in the risk area.

2. The safety method according to claim 1, wherein a geographical location of the gun is determined with a GPS positioning device of the safety device and stored in the memory of the safety device.

3. The safety method according to claim 1, wherein the location data regarding the target, which prevent shooting, is transferred via a wireless data transfer network from a safety area server.

4. The safety method according to claim 1, wherein the location data regarding the target, which prevent shooting, is transferred i) from positioning devices of the targets via radio to the safety device of the gun or to a shooter's mobile phone, and, ii) from the shooter's mobile phone, the location data is transferred to the safety device.

5. The safety method according to claim 4, wherein a current risk area of the gun is determined in the electronic safety device from direction data and location data of the gun.

6. The safety method according to claim 5, wherein the electronic safety device determines when the target is in the determined risk area and then generates a warning that the target is in the determined risk area.

7. The safety method according to claim 6, wherein when the target preventing shooting is in a safety area, then the electronic safety device generates an alarm signal detectable with human senses.

8. The safety method according to claim 1, wherein lifting of the gun into the shooting position is determined by an acceleration sensor.

9. The safety method according to claim 8, wherein a position of a barrel of the gun in a vertical direction is determined with an angle sensor and a geographical shooting direction of the gun is determined with an electronic compass.

10. An electronic safety device of a gun, which is configured to generate a warning regarding a target preventing shooting in a risk area of the gun, which electronic safety device comprises:

a processor unit;

a memory;

data transfer means for establishing at least one wireless data transfer connection;

an acceleration sensor; and an electronic compass, wherein i) before shooting the gun and ii) when the gun has been set in a shooting position, a computer program code stored in the memory of the electronic safety device is, together with the processor unit, configured to generate a warning signal detectable with human senses when the electronic safety device has determined that the target preventing shooting is present in the risk area at the time of shooting by using determination position data and direction data of the gun and location data regarding targets in a safety area of the gun that are i) transferred from mobile phones of moving targets via a cellular telecommunications network to a shooter's mobile phone and, ii) from the shooter's mobile phone is transferred to the electronic safety device and stored in the memory of the electronic safety device.

11. The electronic safety device according to claim 10, wherein the electronic safety device also comprises a GPS receiver for determining the location data of the gun.

12. The electronic safety device according to claim 10, wherein the electronic safety device also comprises an angle sensor for determining an angle between a barrel of the gun and a ground surface.

13. The electronic safety device according to claim 10, wherein the electronic safety device is arranged to retrieve safety area information via a short range radio connection from the mobile phone of a gun user.

14. The electronic safety device according to claim 13, wherein the electronic safety device is arranged to determine the risk area of the gun by using positioning data and safety area information, when positioning data is produced by the acceleration sensor indicates that the gun has been set in the shooting position.

15. The electronic safety device according to claim 14, wherein the electronic safety device is arranged to determine the targets which are situated in the determined risk area, and to generate an alarm detectable with human senses, when such the targets situated in the determined risk area have been determined.

16. The electronic safety device according to claim 15, wherein the safety device is arranged to transfer the generated alarm with time and location data to a hunter's mobile phone.

17. The electronic safety device according to claim 10, wherein the electronic safety device is arranged to receive location data regarding targets preventing shooting from positioning devices of the targets via radio.

18. The electronic safety device according to claim 10, wherein the alarm signal detectable with human senses is at least one of the group consisting of a light signal, a sound signal, and a vibration signal.

19. The electronic safety device according to claim 10, wherein the electronic safety device is part of the gun.

20. The electronic safety device according to claim 10, wherein the electronic safety device is a separate device, which can be attached to a gun.

21. A computer program product comprising computer program code means stored on a non-transitory computer-readable storage means within the data processing device, which code means are arranged to implement all the steps of the method defined in claim 1 when said program is run in a processor unit of a data processing device.

* * * * *